US005255779A

United States Patent [19]

Koenig, III

[11] Patent Number: 5,255,779

[45] Date of Patent: Oct. 26, 1993

[54] FILE FOLDER WITH DISK POCKET

[76] Inventor: C. Frederick Koenig, III, 55 Lenape La., Doylestown, Pa. 18901

[21] Appl. No.: 921,521

[22] Filed: Jul. 29, 1992

Related U.S. Application Data

[63] Continuation of Ser. No. 422,654, Oct. 17, 1989.

[51] Int. Cl.[5] ..... B65D 85/30

[52] U.S. Cl. ..... 206/232; 206/444; 206/473

[58] Field of Search ..... 206/307, 309, 311, 312, 206/313, 444, 425, 472, 473, 474, 475, 232

[56] References Cited

U.S. PATENT DOCUMENTS

| | | | |
|---|---|---|---|
| 4,588,321 | 5/1986 | Egly | 206/444 X |
| 4,620,630 | 11/1986 | Moss | 206/313 X |
| 4,635,797 | 1/1987 | Bankier | 206/425 X |
| 4,651,872 | 3/1987 | Joyce | 206/444 X |
| 4,653,639 | 3/1987 | Traynor | 206/312 X |
| 4,704,042 | 11/1987 | Eisen et al. | 206/312 X |
| 4,709,812 | 12/1987 | Kosterka | 206/311 X |
| 4,765,466 | 8/1988 | Ivey | 206/472 X |
| 5,101,973 | 4/1992 | Martinez | 206/312 |

*Primary Examiner*—Steven N. Meyers
*Assistant Examiner*—Jacob K. Ackun, Jr.
*Attorney, Agent, or Firm*—Volpe & Koenig

[57] ABSTRACT

A file folder having a selectively configured compartment for holding and protecting a computer diskette within a stiff body member is disclosed. The compartment is defined by a spacer member disposed within the left or right cover of the file folder. A method for making and using a file folder in conjunction with a computer diskette with data on it which relates to the papers stored within the file folder is also disclosed.

6 Claims, 3 Drawing Sheets

FILE FOLDER WITH DISK POCKET

This application is a continuation of application Sr. No. 07/422,654 filed on Oct. 17, 1989.

BACKGROUND OF THE INVENTION

1. Field Of The Invention

The present invention relates to file folders, particularly folders used in a business which uses micro computers and floppy diskettes.

2. Description Of The Prior Art

File folders are used to store and protect papers, documents and other articles. A plain manila folder accomplishes this purpose, but does not keep papers attached to the folder. Folders have been devised which use paper fasteners to attach papers and other articles to the folder. In one type, holes are punched in the papers to attach them to the folder.

It is often desirable that certain papers, documents or other articles be retained within a folder, without having holes punched in them. For example, such items may include original documents, evidence, photographs, tax receipts, maps, charts or other similar articles. Folders have been devised which include flaps or pockets into which articles are placed for safekeeping. These folders store and protect the articles and obviate the need to punch holes into the articles. Other similar folder-type articles, such as expanding wallets, expanding pockets, box files, and file jackets are also commonly available for this purpose.

With the widespread use of computers in business, floppy diskettes are used to generate documents and to store information. Each time a letter or other document is needed or dictated for a file to send to a client or customer, a diskette may be used to generate the document.

One of the problems encountered with the known art is the method of storage of computer floppy diskettes. Diskettes may be stored in various plastic or polyethylene storage boxes to protect them from dust and damage. Diskettes may also be kept loose in drawers or in the computer without adequate protection from damage. As a result, diskettes may be damaged from excessive movement, dust, fingerprints, and mutilation. Once a diskette is damaged, the retrieval of information may be impossible or at best entail disruptive recovery procedures.

Another problem is the inability to quickly or easily locate a diskette for a particular file. The present invention recognizes that it is more time efficient and cost effective to use the same diskette for the same file. For example, a letter may be dictated for a particular file, and several days later, a memo or an additional letter may be dictated for transcription for the same file. If the diskette were readily available with the file folder, time would be saved by not having to locate the previously used diskette.

Furthermore, numerous diskettes may also be used inadvertently for a single file. For example, one diskette may be identified or labelled with a particular file, but the transcriber may use a second diskette for the same file to generate a document, failing to label or incorrectly labelling the second diskette. As the number of diskettes and information on the diskettes increases, specific information on the diskettes may be difficult or practically impossible to locate because the diskette has not been labelled or has been incorrectly labelled.

Even when computer data is primarily stored and worked on via an internal hard disk drive, the present invention recognizes the virtue of maintaining a diskette backup of data for individual files. Such individual backup can save a great deal of time in restoring information lost from a hard drive. Moreover, individual association of diskette backups with individual files makes the overall backup system less prone to invasions by computer viruses.

Accordingly, it is desirable that at least one diskette for each file be kept with the file folder, instead of the previously described methods of storage and use.

SUMMARY AND OBJECTS OF THE INVENTION

The present invention comprises an improved file folder.

One characteristic feature of the invention is a retaining or holding compartment for one or more computer floppy diskettes. The compartment is of such a dimension as to accommodate standard floppy diskettes.

Since floppy diskettes are susceptible to damage, an additional feature of the folder is a stiff member which protects the diskette. Preferably, the folder is designed such that closing the folder retains the diskette within the compartment.

It is an object of the present invention to provide a file folder with at least one compartment selectively configured to protect computer software diskettes from dust, damage and excessive movement, and to permit retention and safekeeping of those diskettes with the folder.

It is a further object of the present invention to provide a stiff member to protect a floppy diskette from becoming bent or damaged.

It is a further object of the invention to provide easy access to and to secure retention of the diskette within the folder without unduly inhibiting normal use of the file.

DETAILED DESCRIPTION OF A PREFERRED EMBODIMENT

Figure 2:
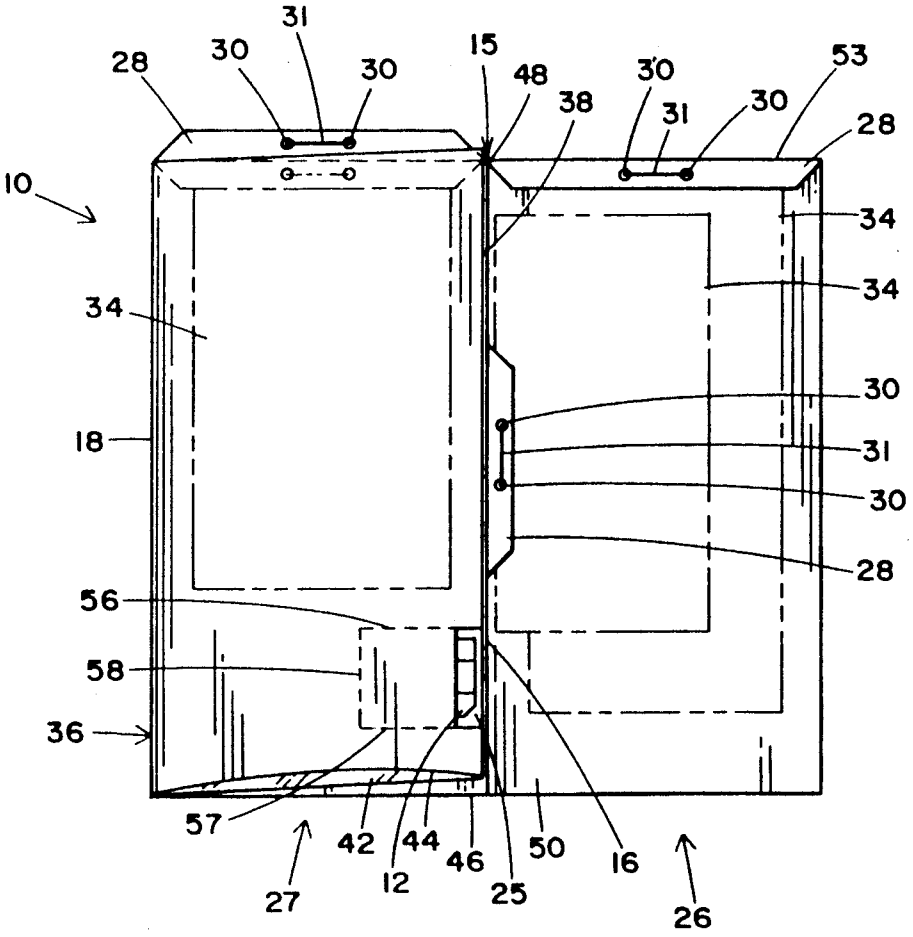
FIG. 2 is an elevated view of the folder shown in FIG. 1 opened 180 degrees.
Figure 1:
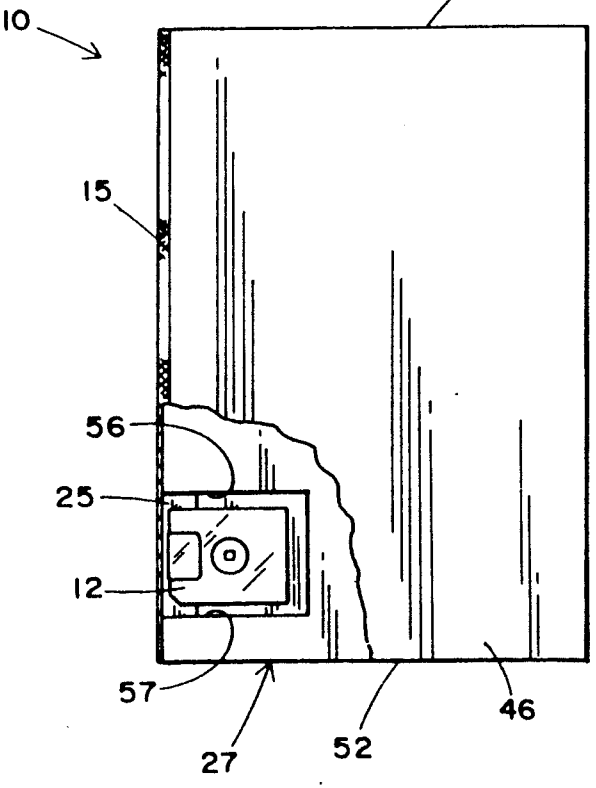
FIG. 1 is an elevated view of a folder with a portion outaway showing a diskette compartment made in accordance with the teachings of the present invention.

With reference to FIGS. 1 and 2, there is shown a file folder 10 having a right cover 26 and a left cover 27 joined along a seam is. The left cover 27 is comprised of a spacer member 42, an inner cover portion 44, and an outer cover portion 46 which define a compartment 25 for receiving and retaining a computer floppy diskette 12. The right cover 26 is comprised of an outer cover portion 48 and an inner cover portion 50 which define a pocket 39.

Preferably, the folder 10 is composed of a stiff manila paper, cardboard, or synthetic material having sufficient strength and durability to protect papers and computer floppy diskettes.

The diskette compartment 25 is selectively placed in the folder 10. As shown in FIGS. 1 and 2, the compartment 25 is placed proximate the bottom horizontal edge 52 of the folder 10. The compartment 25 may be placed in practically any location, so long as the diskette 12 is accessible from the compartment 25. Preferably, the horizontal edges 56 or 57 of the compartment 25 do not coincide with a horizontal edge 52 or 53 of the folder 10. Placement of the compartment 25 as shown permits easy access without interfering with access and use of other materials stored in the file 10.

Tabs 28 are provided along the upper horizontal edge 53 of each cover portion 26, 27 and vertically proximate the seam 15 to attach papers 34, shown in phantom in FIG. 2, to the folder 10. Each tab 28 has a pair of apertures 30. The apertures 30 are selectively placed for receiving a paper fastener 31. The location of the tabs 28 is dependent upon the location of the compartment 25. The location of the tabs 28 with paper fasteners 31 are preferably a sufficient distance away from the compartment 25 to prevent the diskette 12 from being scratched or damaged by a paper fastener 31.

The folder 10 is closed by folding the left cover 27 upon the right cover 26. When the folder 10 is closed, it further protects the diskette 12 from damage and prevents the diskette 12 from becoming dislodged.

Preferably, the folder 10 is a standard legal or letter folder size for purposes of storing standard legal or letter size papers and for placement in a standard legal or letter size filing cabinet. The dimensions of the folder 10 may depend upon the amount and the size of the papers or documents which are to be held within the folder 10.

In order to gain access to the compartment 25, the folder is opened at least 180 degrees. When papers and other documents 34, shown in phantom in FIG. 2, are attached to the folder 10 by paper fasteners 31, the folder 10 may be opened more than 180 degrees to access the compartment.

Figure 3:
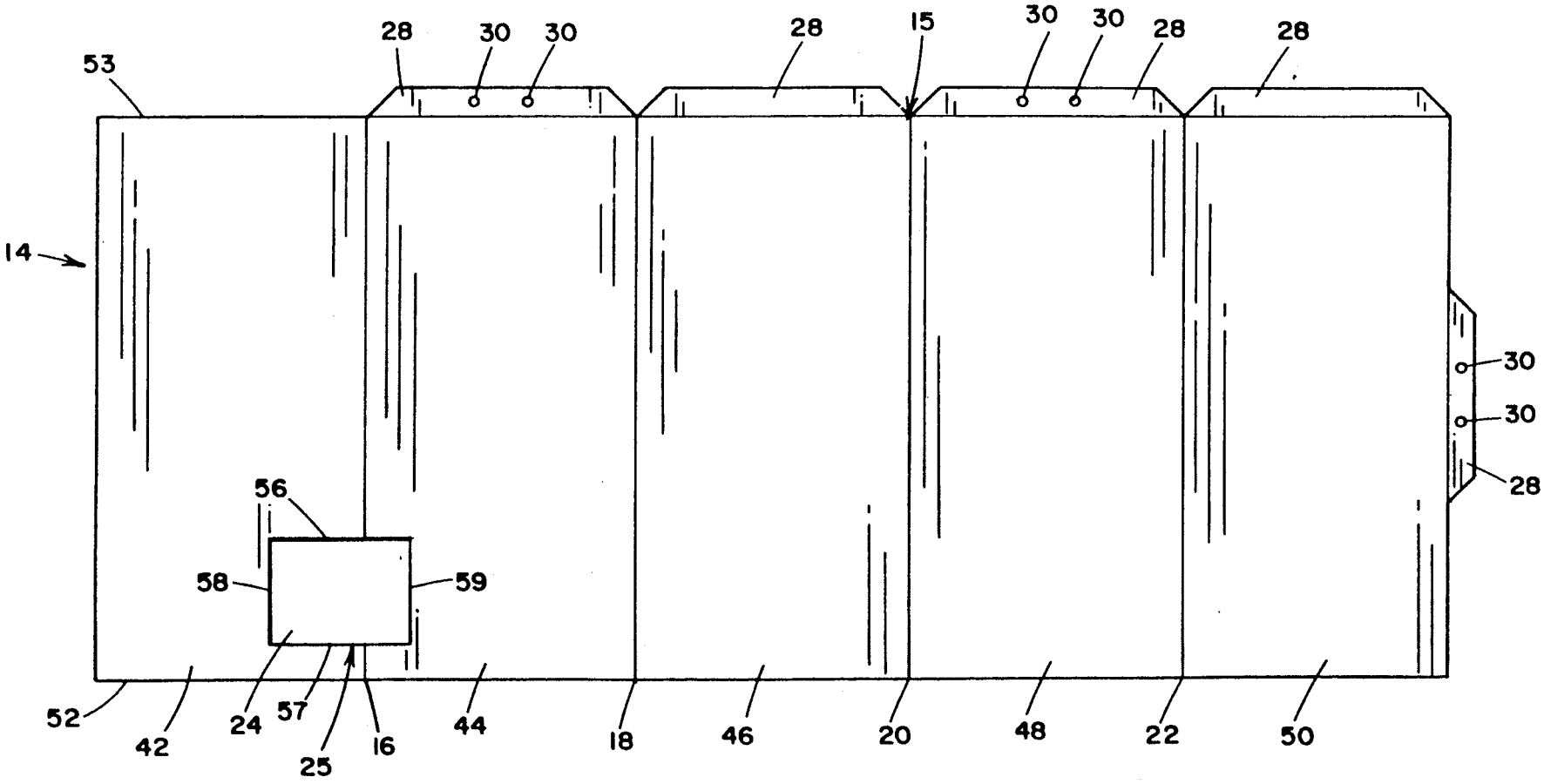
FIG. 3 is an elevated view of a sheet of material from which a folder may be constructed in accordance with the teachings of the invention.

The file folder 10 may be made from a single sheet of material. Referring to FIG. 3, there is shown a selectively shaped and scored piece of sheet material 14 which can be assembled to form the folder 10. The sheet member 14 is divided by creases 16, is, 20, 22 into five sections: a spacer member 42, inner cover portions 44, 50, and outer cover portions 46, 48, having a plurality of tabs 28.

Alternately, the folder 10 may have a plurality of sections or portions which are joined together to form a continuous piece of material. For example, the spacer member 42, inner cover portions 44, 50, and outer cover portions 46, 48, may comprise separate portions and may be joined along the edges or creases 16, 18, 20, 22.

The compartment 25 is formed by selectively defining a rectangular opening 24, as shown in FIG. 3, proximate the bottom horizontal edge 52 of a sheet member 14. The rectangular opening 24 is defined by horizontal edges 56, 57 and vertical edges 58, 59. opening 24 spans across crease 16 so that approximately ¾ of the rectangular opening 24 is defined in the spacer member 42 and approximately ¼ of the opening 24 is defined in the inner cover portion 44. The opening 24 is preferably defined proximate the bottom edge 52, but may be placed in practically any location along crease 16 so long as one horizontal edge 56 or 57 of the opening 24 does not coincide with a horizontal edge 52 or 53 of the sheet member 14. A suitable distance of the horizontal edges 56, 57 of the opening 24 from the edges 52, 53 of the sheet member 14 would be approximately one inch.

Figure 4:
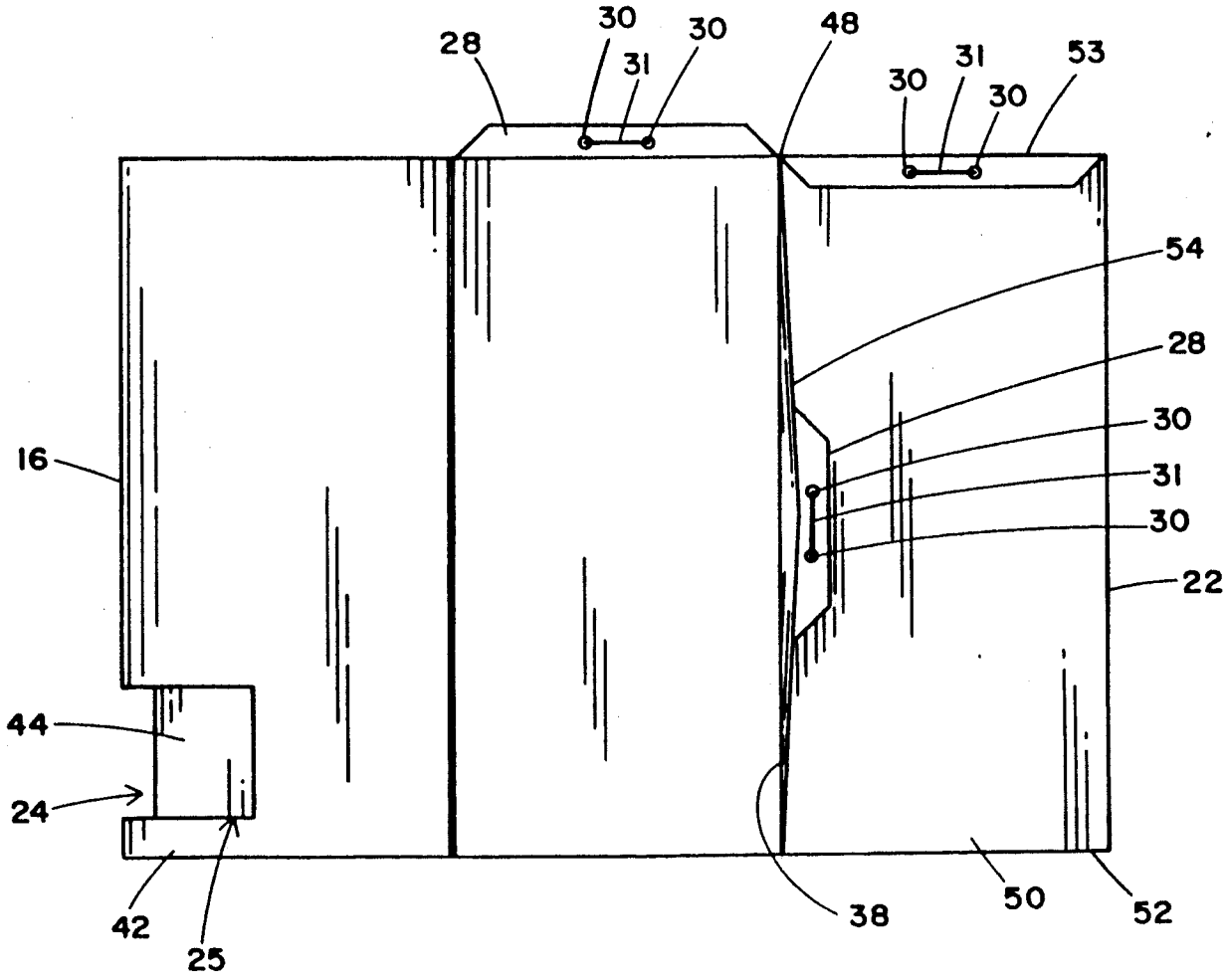
FIG. 4 is an elevated view of the sheet in FIG. 3 at an intermediate stage in the construction of the folder.

Referring to FIG. 4, an intermediate stage in the formation of the compartment 25 is shown. Spacer member 42 is folded along crease 16 over the inner cover portion 44. The rectangular opening 24, which is selectively located between the spacer member 42 and the inner cover portion 44, is likewise folded along crease 16. Inner cover portion So folded along crease 22 is folded over an outer cover portion 48 and joined along the edges 52, 53 forming an interior open pocket 38.

Referring again to FIG. 2, the formation of the compartment 25 is completed by folding the spacer member 42 and inner cover portion 44 along crease 18 and securing them onto outer cover portion 46 to form the left cover 27. When folded in the above described manner, the rectangular opening 24 forms the compartment 25 into which a computer diskette 12 may be inserted, held in place and protected from damage.

The compartment 25 is preferably dimensioned to hold a single diskette. For example, to accommodate a standard 5 ¼ inch diskette the portion of the opening 24 defined in spacer member 42 is preferably a square approximately 5 3/8 inches on each side with the spacer member 42 being approximately 1/16 inches (or less) thicker than the diskette this results in the preferred single diskette compartment being no more than 1/16" greater than the thickness of the diskette. However, more than one diskette 12 may be placed in compartment 25 by increasing its height which is dependent upon the thickness of the spacer element 42. For conventional "floppy" 5¼ inch diskettes the compartment may be dimensioned to accommodate a diskette sleeve jacket; where the more rigid 3 ½ inch diskettes are to be accommodated no allowance for a sleeve is generally necessary.

The spacer member and inner and outer cover portions 42, 44, 46, respectively, when folded and secured together form the left cover 27 into a relatively stiff body. This provides support for the diskette 12 when disposed within the compartment 25. Such support protects the diskette 12 from being bent, excessive movement, mutilation, and other damage. The diskette 12 is held in place in the folder 10 within the left cover 27 by the edges 56, 57 and 58 of the folded rectangular opening 24.

The folder 10 may have a plurality of compartments 25, depending on the needs of the user or the type of file. The location of such additional compartments 25 should be selected so that the strength and stiffness of the cover is not significantly diminished. The number of compartments 25 is limited by the width of the sheet member 14 and the need to assure a suitable rigidity of the covers 26, 27 to protect the diskettes.

The folder seam 15 may comprise reinforcement material and/or expandable means to increase the capacity and prolong the useful life of the folder 10. The folder 10 may also be provided with closure means attached to the exterior. The means for securing the folder 10 and for keeping it closed (not shown) may consist of ties or elasticized material, or any other suitable material capable of keeping the folder 10 closed.

It is preferred that the compartment 25 be accessed internally within the folder 10. However, the compartment 25 may be externally accessed if the rectangular opening 24 is located along crease IS or 20 or edges 52 or 53.

I claim:

1. A file folder comprising:

first and second opposing covers joined along one edge for relative pivotal rotation for opening the folder from a closed position whereat said opposing covers are in substantially parallel planes atop each other through at least an arc of 180° whereat the said opposing covers are adjacent to each other in substantially the same plane;

said first cover including an outer cover portion, an inner cover portion and a spacer member disposed between said inner and outer cover portions;

said spacer member having a selected thickness and having an aperture therein to define a selectively dimensioned compartment for receiving and retaining a computer diskette of a predetermined size, said compartment being adjacent to said joined edge of said first cover;

said inner and outer cover portions cooperating with said spacer member to provide stiffness to said first cover so that when a diskette is disposed in said compartment it is protected from being bent, crushed and excessively moved;

means for securing papers to the folder;

an exposed slot defined in said inner cover portion of said first cover for accessing said compartment, said slot being adjacent and parallel to said joined edge of said first cover and configured such that the computer disk can only be slidably inserted into or removed from said compartment through movement in a plane substantially coplaner with said spacer member;

said second cover restricting access to said slot thereby serving to retain a diskette in said compartment until said opposing covers are opened at least 180°; and, a computer diskette of said predetermined size disposed in said compartment.

2. The folder of claim 1 wherein said first and second opposing covers are formed from a selectively shaped and scored piece of sheet material.

3. The folder of claim 1 wherein said first and second opposing covers are each formed from a selectively shaped and scored piece of sheet member.

4. A file folder comprising:

four rectangular-shaped members which are joined in series along their edges by three parallel seams, including respectively a rectangular-shaped spacer member, a rectangular-shaped inner cover portion, a first rectangular-shaped outer cover portion, and a second rectangular-shaped outer cover portion;

said spacer member and said inner cover portion having a rectangular aperture defined through them which extends across a first seam which joins them such that a portion of said aperture defined in said spacer member is for receipt of a computer diskette and said portion of said aperture through said inner cover portion is smaller than said portion of said aperture defined in said spacer member;

said spacer member being folder upon said first inner cover portion trough an arc of 180° about said first seam such that said spacer member and said first inner cover portion are one on top of the other;

said spacer member and said inner cover portion being folded upon and affixed to the interior of said first outer cover through an arc of 180° about a second seam which joins the inner cover portion and the first outer cover portion such that said first outer cover portion is adjacent to and on top of said spacer member, said portion of said aperture defined in said spacer member forming a compartment between said inner cover portion and said first outer cover portion, said portion of said aperture through said inner cover portion and said first seam forming an access slot into said compartment such that a computer disk of the selected size can only be slidably inserted into or removed from said compartment through movement in a plane substantially coplanar with said spacer member; and, said second rectangular-shaped outer cover portion being joined by a third seam to said first outer cover portion for relative pivotal rotation from a closed position to an open position, whereby it restricts access to said slot and serves to retain a diskette in said rectangular opening until said second outer cover is opened at least 180°.

5. The folder claimed in claim 4 wherein the series of rectangular-shaped members includes a second inner cover portion which is joined by a fourth parallel seam to said second outer cover portion, said second inner cover portion being folded through an arc of 180° about said fourth seam and affixed to the interior of said second outer cover portion to form an open pocket.

6. A file folder comprising:

first and second opposing covers joined along one edge for relative pivotal rotation for opening the folder from a closed position whereat said opposing covers are in substantially parallel planes atop each other through at least an arc of 180° whereat the said opposing covers are adjacent to each other in substantially the same plane;

said first cover including an outer cover portion, an inner cover portion and a spacer member disposed between said inner and outer cover portions;

said spacer member having a selected thickness and having an aperture therein to define compartment therethrough for receiving and retaining a computer diskette, said compartment being adjacent to said joined edge of said first cover;

said inner and outer cover portions cooperating with said spacer member to provide stiffness to said first cover so that when a diskette is disposed in said compartment it is protected from being bent, crushed and excessively moved;

an exposed slot defined in said inner cover portion of said first cover for accessing said compartment, said slot being adjacent and parallel to said joined edge of said first cover and configured such that the computer disk can only be slidably inserted into or removed from said compartment through movement in a plane substantially coplanar with said spacer member;

said second cover restricting access to said slot thereby serving to retain a diskette in said compartment until said opposing covers are opened at least 180°.

* * * * *

UNITED STATES PATENT AND TRADEMARK OFFICE

CERTIFICATE OF CORRECTION

PATENT NO. : 5,255,779
DATED : October 26, 1993
INVENTOR(S) : C. Frederick Koenig III It is certified that error appears in the above-indentified patent and that said Letters Patent is hereby corrected as shown below:

At column 3, line 39, delete "180" and insert therefor --180--.

At column 3, line 45, after the number "16", delete "is" and insert therefor --18--.

At column 3, line 59, delete "opening" and insert therefor --Opening--.

At column 4, line 9, after the word "portion", delete "So" and insert therefor --50--.

At column 4, line 67, delete "IS" and insert therefor --18--.

IN THE CLAIMS

In claim 4, at column 5, line 61, delete "folder" and insert therefor --folded--.

Signed and Sealed this

Nineteenth Day of April, 1994

*Attest:*

*Attesting Officer*

BRUCE LEHMAN

*Commissioner of Patents and Trademarks*